US006374440B1

(12) United States Patent
Thim, Jr.

(10) Patent No.: US 6,374,440 B1
(45) Date of Patent: Apr. 23, 2002

(54) BACK SUPPORT

(76) Inventor: Arthur W. Thim, Jr., 609 W. Mount Vernon St., Lansdale, PA (US) 19446

( * ) Notice: Subject to any disclaimer, the term of this patent is extended or adjusted under 35 U.S.C. 154(b) by 0 days.

(21) Appl. No.: 09/553,407

(22) Filed: Apr. 20, 2000

Related U.S. Application Data

(60) Provisional application No. 60/130,093, filed on Apr. 20, 1999.

(51) Int. Cl.[7] ..... A47C 21/00; A47C 21/08

(52) U.S. Cl. ..... 5/633; 5/426; 5/503.1

(58) Field of Search ..... 5/632, 633, 424, 5/425, 426, 428, 429, 430, 503.1, 658, 659, 639, 485; 220/345.1, 345.5

(56) References Cited

U.S. PATENT DOCUMENTS

| | | | | | |
|---|---|---|---|---|---|
| 1,156,125 | A | | 10/1915 | Ahlborn | 5/633 |
| 2,071,155 | A | * | 2/1937 | Alexander | 5/426 X |
| 2,105,336 | A | * | 1/1938 | Smith | 5/633 X |
| 2,663,880 | A | | 12/1953 | Meeks | 5/634 |
| 2,709,817 | A | | 6/1955 | Poyer | 5/59.1 |
| 2,859,454 | A | * | 11/1958 | Beckwell | 5/426 |
| 2,904,799 | A | * | 9/1959 | Berlin | 5/426 |
| 2,991,487 | A | * | 7/1961 | Beckwell | 5/426 |
| 3,110,911 | A | * | 11/1963 | Osborne et al. | 5/633 X |
| 3,130,289 | A | | 4/1964 | Katzman | 219/479 |
| 3,290,701 | A | * | 12/1966 | Luff | 5/426 |
| 3,343,185 | A | * | 9/1967 | Nemser | 5/633 |
| 3,402,409 | A | | 9/1968 | Kain | 5/426 |
| 3,474,473 | A | * | 10/1969 | Hannaberg | 5/426 |
| 3,720,965 | A | | 3/1973 | Wright | 297/352 |
| 3,806,968 | A | | 4/1974 | Robey | 5/660 |
| 3,895,840 | A | * | 7/1975 | Szurszewki | 5/633 X |
| 3,981,031 | A | | 9/1976 | Schacht | 5/634 |
| 4,104,751 | A | | 8/1978 | Churchman | 5/503.1 |
| 4,185,342 | A | | 1/1980 | Young | 5/634 |
| 4,214,326 | A | | 7/1980 | Spann | 5/632 |
| 4,744,117 | A | | 5/1988 | Bond | 5/632 |
| 4,833,743 | A | | 5/1989 | Howell et al. | 5/426 |
| 5,189,748 | A | | 3/1993 | Garrison et al. | 5/655 |
| 5,370,246 | A | * | 12/1994 | Traynor | 211/86.01 |
| 5,437,067 | A | | 8/1995 | Bernstein et al. | 5/426 |
| 5,545,199 | A | | 8/1996 | Hudson | 607/109 |
| 5,577,277 | A | * | 11/1996 | Sundberg et al. | 5/426 |
| 5,651,152 | A | * | 7/1997 | Ritchie et al. | 5/503.1 |
| D391,792 | S | | 3/1998 | Scherer et al. | D6/503 |
| 5,761,756 | A | | 6/1998 | Nowak | 5/426 |
| 5,765,244 | A | * | 6/1998 | Heidler | 5/633 X |
| 6,134,731 | A | * | 10/2000 | Thom et al. | 5/426 X |

FOREIGN PATENT DOCUMENTS

| | | |
|---|---|---|
| FR | 1449012 | 7/1966 |
| GB | 2225716 | 6/1990 |

* cited by examiner

*Primary Examiner*—Robert G Santos
(74) *Attorney, Agent, or Firm*—Richard C. Litman

(57) ABSTRACT

A back support provides a generally vertical and rigid panel removably installable along one edge of a bed, against which a person may brace his or her back or other body part as desired while reclining on the bed. The present support comprises a frame with two opposed legs extending therefrom, with the legs each having a ninety degree bend therein. The legs may thus be inserted horizontally between the mattress and box spring or frame of a bed, with the frame being held generally vertically at the edge of the bed. The legs also telescope within the ends of the frame for height adjustment, and pivot to lie coplanar with the frame for carriage and storage of the device. The frame includes a rigid panel thereacross, with the panel having a cushion removably secured thereto and facing the center of the bed when the support is installed on the bed. The cushion includes a series of pockets on the outer surface thereof, for the removable insertion of therapeutic articles (e.g., hot and cold packs, etc.) therein. The frame may include additional structure to provide sufficient thickness for one or more storage compartments therein, if desired, for the storage of hot and cold packs, liniments, etc., as desired. The device is easily carried by a handle which is secured about the two adjacent folded legs to secure them together when the device is not in use. A cover may be provided for storage or for additional padding as desired.

18 Claims, 7 Drawing Sheets

BACK SUPPORT

REFERENCE TO RELATED PATENT APPLICATION

This application claims the benefit of U.S. Provisional Patent Application Serial No. 60/130,093, filed on Apr. 20, 1999.

BACKGROUND OF THE INVENTION

1. Field of the Invention

The present invention relates generally to physical therapeutic devices, and more specifically to a back support providing a generally vertical panel against which a person may rest his or her back. The panel includes an upholstered area with provision for warm or cold packs and angled legs which may be placed beneath the mattress of a bed to support the panel properly.

2. Description of the Related Art

Back pain and stress are recurring problems for many people, and it can prove difficult to find appliances which are capable of relieving such pain and stress. Most back problems are relatively minor in nature (strained muscles, etc.), and do not warrant intensive care or costly medical assistance. Nevertheless, the pain and suffering from such minor back problems is just as real, and perhaps just as painful, as more serious problems.

Accordingly, various devices have been developed in the past, with most being directed to support from beneath a person resting thereon. A few devices have been developed for persons resting in some other position, but most have not proven completely satisfactory for various reasons (lack of provision for hot or cold packs, etc.). It is well established that many, if not most, people prefer to rest or sleep on their sides, rather than lying supine upon their backs. It can be quite difficult to provide the desired support and/or warmth or cooling desired for a person with a back problem who is resting on his or her side, particularly with most existing therapeutic devices.

Accordingly, a need will be seen for a therapeutic back support for applying therapeutic pressure, warmth, and/or cold to the back of a person resting upon his or her side. The device includes anchor means comprising a pair of angled legs which extend between the mattress and box spring of the bed to provide secure anchoring for the generally vertical back support panel. The panel includes a rigid panel or sheet, to which an upholstered pad is removably attached. The pad preferably includes a plurality of pockets or pouches in which heating or cool packs may be provided as desired. Additional storage may be included with the device for storing small articles (liniment, etc.) as desired. A padded cover may be provided for additional comfort and storage of the device.

A discussion of the related art of which the present inventor is aware, and its differences and distinctions from the present invention, is provided below.

U.S. Pat. No. 1,156,125 issued on Oct. 12, 1915 to Mattie E. Ahlborn, titled "Head And Back Rest," describes a flexible panel supported on three sides by a rigid frame. The frame includes a pair of lower supports which rest atop the mattress or sheets of the bed, and a pair of upper supports extending from the upper crossmember of the frame, which hook over the top rail of the headframe of the bed. The device is thus disposed at an angle, from the top of the headframe downwardly to the mattress at some distance from the headframe. Ahlborn does not provide any means of cantilever support for holding his support vertically along one edge of the bed, nor any means of holding warm or cold packs, as provided by the present invention.

U.S. Pat. No. 2,663,880 issued on Dec. 29, 1953 to James W. Meeks, titled "Collapsible Back Rest," describes an adjustable frame with a flexible sheet thereover. The frame rests atop the mattress of a bed and against the headframe or headboard of the bed, to support the flexible sheet at some adjustable angle between the horizontal and the vertical. As in the case of the Ahlborn device discussed above, Meeks does not provide any means of cantilever attachment to the bed for a vertical support surface, nor any means of holding a hot or cold pack or the like, both of which features are provided by the present back support invention.

U.S. Pat. No. 2,709,817 issued on Jun. 7, 1955 to Charles E. Poyer, titled "Back Rest For Convertible Couch Beds," describes a rack supported on the floor behind a convertible couch, with the couch having a standard bed width. The Poyer rack includes a frame for holding the cushions away from the wall behind the convertible couch, for providing the proper width to the convertible couch when used as a couch. The device folds against the wall when the couch is converted to a bed. Poyer does not provide any specific upholstered back support, other than the cushions of the couch itself, and does not provide for holding a heat or cold pack, as provided by the present invention. The Poyer device is not supported by the couch itself, but rests on the floor, whereas the present support is cantilevered from the bed. Moreover, the Poyer frame does not provide vertical support for the cushions, whereas the present back support comprises a generally vertical panel.

U.S. Pat. No. 3,130,289 issued on Apr. 21, 1964 to Lawrence Katzman et al., titled "Collapsible Heating Pad For Travelling," describes an electrically powered heating pad which is adaptable for 110 or 220 volt power. While the present invention might make use of an electrical heating pad, it is better adapted for other types of heating and cooling packs not requiring electrical energy, or at least not requiring an electrical cord, as does the Katzman et al. pad. Katzman does not describe any form of back rest or support, as provided by the present back support invention.

U.S. Pat. No. 3,402,409 issued on Sep. 24, 1968 to Arthur F. Kain, titled "Child Guard," describes a device formed of two flat panels. The first panel is adapted for positioning between the mattress and box spring of a bed, and includes a series of slots along the outer edge thereof. The second panel includes a series of tongues or extensions for removably installing in the slots of the first panel. When the first panel is disposed horizontally between the mattress and box spring, the second panel extends generally vertically upwardly therefrom. However, the second panel will not remain normal to the first panel, as the slots will allow some arcuate play of the second panel relative to the first panel. The present invention provides a rigid, tubular frame which holds the upper panel in a fixed relationship to the lower portion which extends between mattress and box spring.

U.S. Pat. No. 3,720,965 issued on Mar. 20, 1973 to Harry W. Wright, titled "Back Support," describes a device having an inclined upper portion adapted to rest against the headboard of a bed, with a lower flange for placing between the headboard and upper mattress. The upper portion is not substantially vertical to the mattress, nor does it include any form of padding or cushioning, as provided by the present back support. Moreover, the Wright device cannot be retained along a lateral edge of a bed, as Wright must rely upon some other closely adjacent bed structure (i.e., headboard) to prevent his support from sliding from the bed, unlike the present invention with its lower frame portion which is adapted for removable insertion between mattress and box spring.

U.S. Pat. No. 3,806,968 issued on Apr. 30, 1974 to Edward Robey, titled "Orthopaedic Back Support Appliance," describes a device having a relatively large radius upper portion with a screw jack therebeneath. The device is inserted between mattress and box spring, and the screw jack adjusted to provide the desired lift. The device provides lumbar support for a person resting on the mattress, or can provide support for the side of the torso between rib cage and hip for a person lying on his or her side. However, Robey does not provide any upwardly extending, generally vertical panel for providing lateral support for a person resting in a bed, as provided by the present back support invention.

U.S. Pat. No. 3,981,031 issued on Sep. 21, 1976 to Louis L. Schacht, titled "Inclined Bedrest," describes a device having a plate for placing between mattress and box spring, with a storage area extending upwardly therefrom for holding the bedrest frame. The frame extends from the storage area and is locked into place by a pair of arms which are swiveled to extend over the mattress. The distal ends of these arms also provide for holding the lower end of a sheet, which extends at an angle downwardly from the upper edge of the frame to the distal ends of the arms. The Schacht device cannot provide a vertical support panel, as when the two arms are swiveled back to lie coplanar with the frame and storage area, the frame is unsupported and retracts back into the storage area. Moreover, the light, flexible sheet of the Schacht device cannot provide rigid support, as provided by the rigid, vertical support panel of the present back support device.

U.S. Pat. No. 4,104,751 issued on Aug. 8, 1978 to M. Steele Churchman, titled "Endboard Auxiliary Device For Beds," describes a device having a first panel for inserting between the mattress and box spring of a bed, with a second panel being hinged to one edge of the first panel. The second panel is held upright by means of its extension below the first panel, where it levers against the box spring when an outward force is placed upon the upper portion thereof. Churchman does not disclose any form of cushioning or padding for his device, nor any form of storage means therein, as provided by the present back support. Moreover, the tubular frame structure of the present back support is completely unlike the flat board structure of the Churchman device.

U.S. Pat. No. 4,214,326 issued on Jul. 29, 1980 to Donald C. Spann, titled "Body Positioner And Protection Apparatus," is describes a two piece resilient foam device comprising a generally triangular cross section lateral support with a bed rail guard which is cut from the center of the larger triangular cross section piece. The Spann device does not cantilever from between mattress and box spring, as provided by the present back support, but must rely upon side rails of the bed to hold it in position. Moreover, the Spann device cannot provide vertical lateral support, as provided by the present back support, due to the sloping rest surface of the Spann device. If the Spann device were turned around to position the vertical surface toward the resting person, the vertical wall would be positioned close to the center of a standard bed, leaving practically no room for the resting person.

U.S. Pat. No. 4,185,342 issued on Jan. 29, 1980 to Raymond E. Young, titled "Portable, Adjustable Backrest For Beds And The Like," describes a relatively complex assembly having a base panel and an angularly adjustable panel hinged to one edge of the base panel. An adjusting mechanism is installed between the two panels, with the adjustable support panel including a relatively large hump extending therefrom for clearance for the adjusting mechanism when the two panels are folded together. The device cannot be positioned with the support panel at the edge of the bed, as provided by the present invention, as the lower panel of the Young device cannot be inserted between mattress and box spring due to the mechanism and relationship between the two panels. The upper adjustable support panel of the Young device would thus be positioned well inwardly from the edge of the mattress, where it leaves relatively little room on the surface of the bed. The present support allows the entire upper surface of the mattress to remain open and available for use.

U.S. Pat. No. 4,744,117 issued on May 17, 1988 to Helen I. Bond, titled "Prop-Like Positioning Device For Hemiside Reclining Persons," describes a device comprising a generally flat sheet having a bolster or the like stitched to one lateral edge thereof and an opposite folded over edge for containing a relatively smaller bolster or padding. Straps are provided to secure the device to the top of the bed, with the user lying atop the device. Accordingly, Bond does not provide a rigid cantilevered panel at the edge of the bed, as provided by the present back support.

U.S. Pat. No. 4,833,743 issued on May 30, 1989 to William R. Howell et al., titled "Bed Safety Side Rail," describes a device having a pair of legs which are inserted between box spring and mattress. A panel extends adjustably from the two legs. The panel comprises a frame with a fabric covering, unlike the rigid panel material of the present back support. Such a rigid panel is desired for a back support, to provide the desired firmness. The Howell et al. panel may be arcuately adjusted between a lowered and a raised position, with the raised position being substantially vertical. In contrast, the present back support has a frame which is rigid when the two legs are extended therefrom, thus insuring that the rigid support panel will remain substantially vertical. Moreover, Howell et al. do not disclose any provision for holding a heating or cooling pad therein, nor for storing articles, both of which means are provided by the present back support.

U.S. Pat. No. 5,189,748 issued on Mar. 2, 1993 to Tina A. Garrison et al., titled "Infant Side Support Sleeper," describes a blanket or the like having a relatively long bolster stitched thereto at about one third of the width of the blanket, and a generally round bolster opposite the long bolster, again stitched to the blanket at about one third the distance from the opposite edge. The flexible nature of the blanket precludes anchoring beneath the edge of the mattress and any provision for a cantilevered panel, as provided by the present back support, and the two bolsters take up a considerable amount of space atop the bed and are unsuitable for a person much larger than an infant.

U.S. Pat. No. 5,437,067 issued on Aug. 1, 1995 to Michael S. Bernstein et al., titled "Bed Side Rails," describes a device somewhat like the side rail device of the Howell et al. '743 U.S. Patent discussed further above. The Bernstein et al. side rail folds arcuately downwardly when released from its locked upright position, unlike the present back support. Bernstein et al. do not disclose any form of cushioning or padding on the vertical panel of their side rail, whereas such cushioning is provided with the present device. Also, Bernstein et al. do not provide any means of folding the legs inwardly to lie essentially coplanar with the side panel for storage and carriage, as provided by the present back support. Other than provision for a flashlight, Bernstein et al. do not provide any storage area with their side rail, whereas such storage means is provided in the present back support.

U.S. Pat. No. 5,545,199 issued on Aug. 13, 1996 to Gary C. Hudson, titled "Hot And Cold Therapeutic Pillow," describes a pillow having a hollow interior for the insertion of a hot or cold pack therein. No means of securing the device to a bed or other structure for use as a back support, is disclosed by Hudson. While the present back support may make use of such hot and cold packs as mentioned by Hudson for use within his therapeutic pillow, no other similarities are apparent between the Hudson device and the back support of the present invention.

U.S. Pat. No. 5,761,756 issued on Jun. 9, 1998 to Ralph M. Nowak et al., titled "Portable Bed Rail," describes a device more closely resembling the device of the Howell et al. '743 U.S. Patent, discussed further above, than the present back support. The Nowak et al. device has a pair of lateral members over which a cloth or mesh cover extends. As in the case of the Howell et al. device, the panel formed is not rigid, nor is any cushioning provided. The two support legs extend between a mattress and box spring, but the folding mechanism is unlike that of the present back support. Moreover, Nowak et al. do not provide any means of holding a heating or cooling pad, nor any storage means in their bed rail, whereas the present back support provides for both such features.

U.S. Pat. No. D-391,792 issued on Mar. 10, 1998 to Craig S. Scherer et al., titled "Portable, Foldable Bed Rail," illustrates a design having an appearance somewhat like the side rail of the Bernstein et al. '067 U.S. Patent discussed further above. The Scherer et al. design appears to show a structure formed of a relatively thin material (indicated by the edges shown in the folded configuration shown in FIG. 8 of the Scherer et al. disclosure), which would require a relatively hard material to provide the required structural strength. In contrast, the present back support includes a padded cushion disposed inwardly thereon, i.e., toward the top of the bed, when the device is installed on a bed. Scherer et al. do not provide any form of storage nor means for holding a hot or cold pack, as provided by the present device.

French Patent Publication No. 1,449,012 published on Jul. 4, 1996 illustrates a device for holding an infant away from the edge of a bed or the like. The device comprises a pair of mirror image cushions and a strap for securing the cushions about each side of the infant. With the cushions thus secured, the infant cannot roll to either side. The device is thus more closely related to the infant support of the '748 U.S. Patent to Garrison et al., discussed further above, than to the present invention. No means is apparent in the French Patent Publication for providing a rigid, generally vertical panel for back support, as provided by the present invention.

Finally, British Patent Publication No. 2,225,716 published on Jun. 13, 1990 to Alfred A. Barnett, titled "Collapsible Non-Slipping Bed Guard," describes a tubular frame having an elastic mesh stretched thereacross. The frame has a pair of legs extending therefrom, which may be swiveled about a vertical axis to extend normal to the frame, or to fold coplanar with the frame. The legs are adapted for extending between the mattress and box spring or bed frame of a bed. The two legs of the device each include an L-shaped extension, for holding the opposite edge of the mattress, box spring, or bed frame. However, no rigid support panel, cushioning thereon, internal storage means, or means for holding a therapeutic pack, is disclosed in the British Patent Publication, while each of the above features is a part of the present device.

None of the above inventions and patents, either singly or in combination, is seen to describe the instant invention as claimed.

SUMMARY OF THE INVENTION

The present invention comprises a back support providing a rigid, generally vertical panel disposed at one side of a bed, against which the back or other body part of a user may be braced or supported. The device basically comprises a rigid, generally rectangular frame with opposite support legs extending from the lower edge or portion thereof. The two support legs extend essentially normal to the frame and are inserted between the mattress and box spring (or other bed structure) to position the frame and attached panel vertically at one side or edge of the bed. The panel includes removable cushioning or padding thereon, with the cushion including a plurality of pockets thereon for the removable insertion of various therapeutic articles (e.g., hot and cold packs, etc.) therein. The cushion cover may be opened for access to the cushion therein, as desired. The present back support also includes storage areas between the rigid panel and the frame, for storage of such therapeutic articles.

The legs of the device may be extended or retracted as desired to accommodate the thickness of a mattress, and to place the lower edge of the rigid panel or cushion thereon at the upper edge of the mattress. The legs are also foldable, by pivoting them inwardly about their telescoping axes with the lateral frame members so they are essentially coplanar with the frame, for compact storage. A handle may be provided to secure the legs together for carriage and storage, as desired.

Accordingly, it is a principal object of the invention to provide an improved back support for providing a rigid, generally vertical support panel disposed at the edge or side of a bed, for bracing or supporting the back or other body part of a user thereagainst.

It is another object of the invention to provide an improved back support having a generally rectangular frame with opposite legs extendible generally normal to the frame, with the legs providing for insertion between the mattress and box frame of a bed for anchoring the present back support thereto.

It is a further object of the invention to provide an improved back support which anchor legs are telescopingly adjustable and pivotally foldable for compact storage of the support.

An additional object of the invention is to provide an improved back support including storage means for various articles and cushioning means removably disposed upon the rigid panel.

Still another object of the invention is to provide an improved back support which cushioning means includes a plurality of pockets thereon for removable insertion of therapeutic articles therein.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises a back support for providing a rigid, vertical support for the spine or other body components for a person resting upon a bed or other suitable area for reclining, resting, or sleeping. The present support provides a firm and rigid back board or panel disposed upon a rigid frame, with the frame including storage means therein. A removable cushion or padding is provided on the panel, with the cushion including means for placement of additional therapeutic devices therein.

Figure 1:
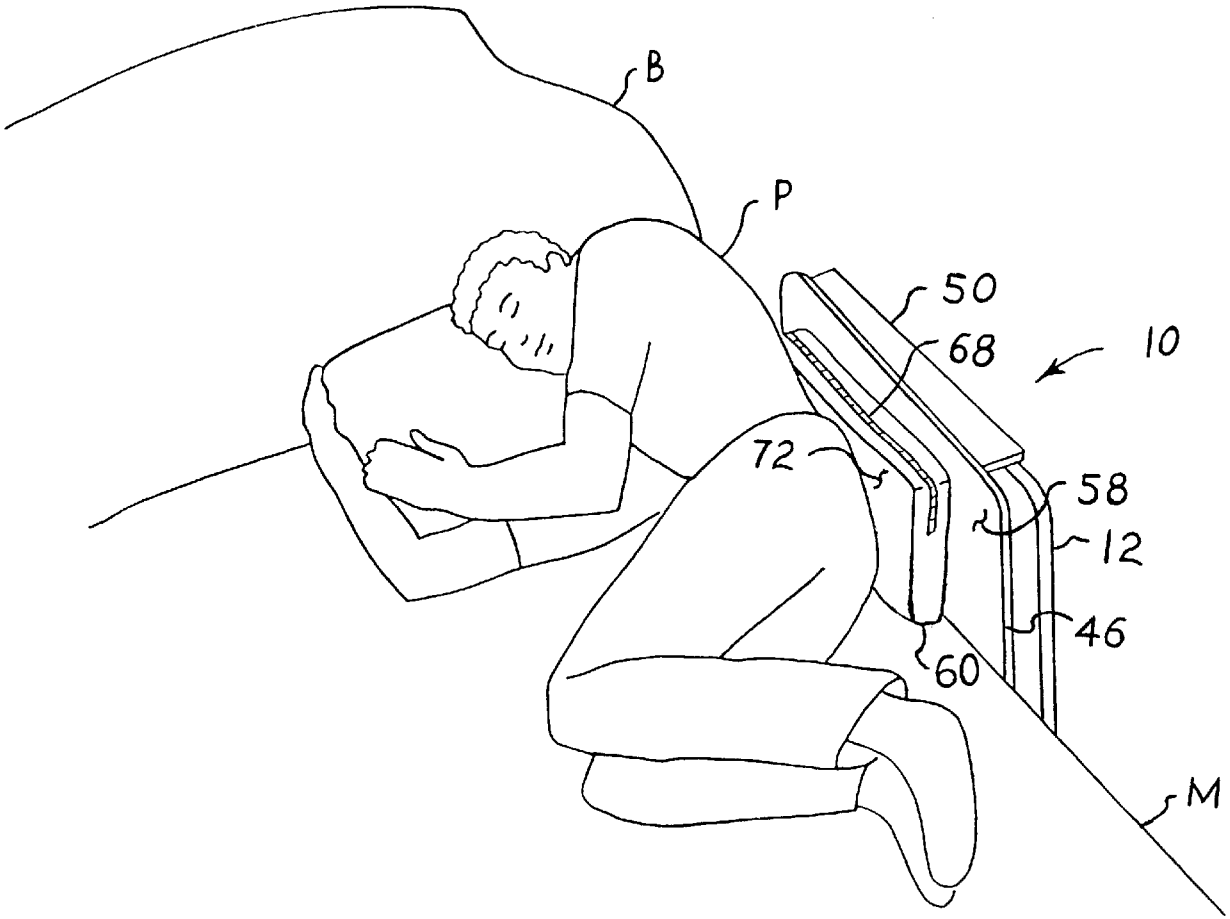
FIG. 1 is an environmental perspective view of the present back support in use, showing a person with the back braced thereagainst.
Figure 2:
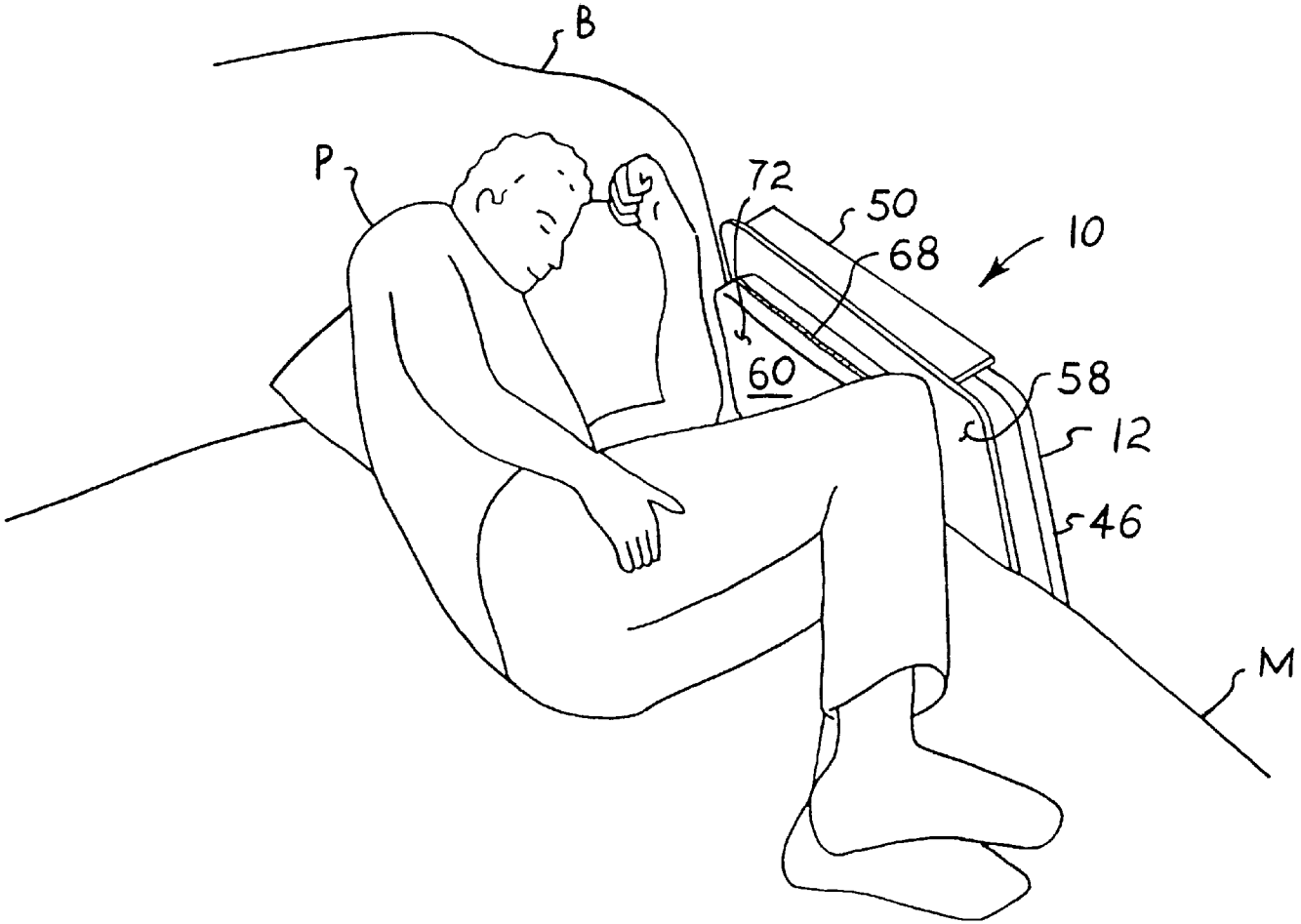
FIG. 2 is an environmental perspective view similar to FIG. 1, but showing the user turned to face the support.

FIGS. 1 and 2 provide exemplary views showing how the present back support 10 might be used by a reclining person P in a bed B. In FIGS. 1 and 2, the back support 10 has been secured between the mattress M and box spring S (or other underlying structure) of a bed B, for providing a generally vertical rigid panel for supporting the back of a person P resting upon the bed B. In FIG. 1, the person P is reclining on his right side, with his back against the padded vertical panel of the back support 10. This assists in reducing curvature of the spine in such a reclining or sleeping position, and reduces back strain or pain from exertion or from sleeping in such a position. In FIG. 2, the person P has turned over to lie upon his left side, facing the vertical panel of the back rest 10. With the knees drawn up against the panel of the back rest 10, the body is braced and cannot readily twist the back to a posture which might cause undue back strain.

Figure 3:
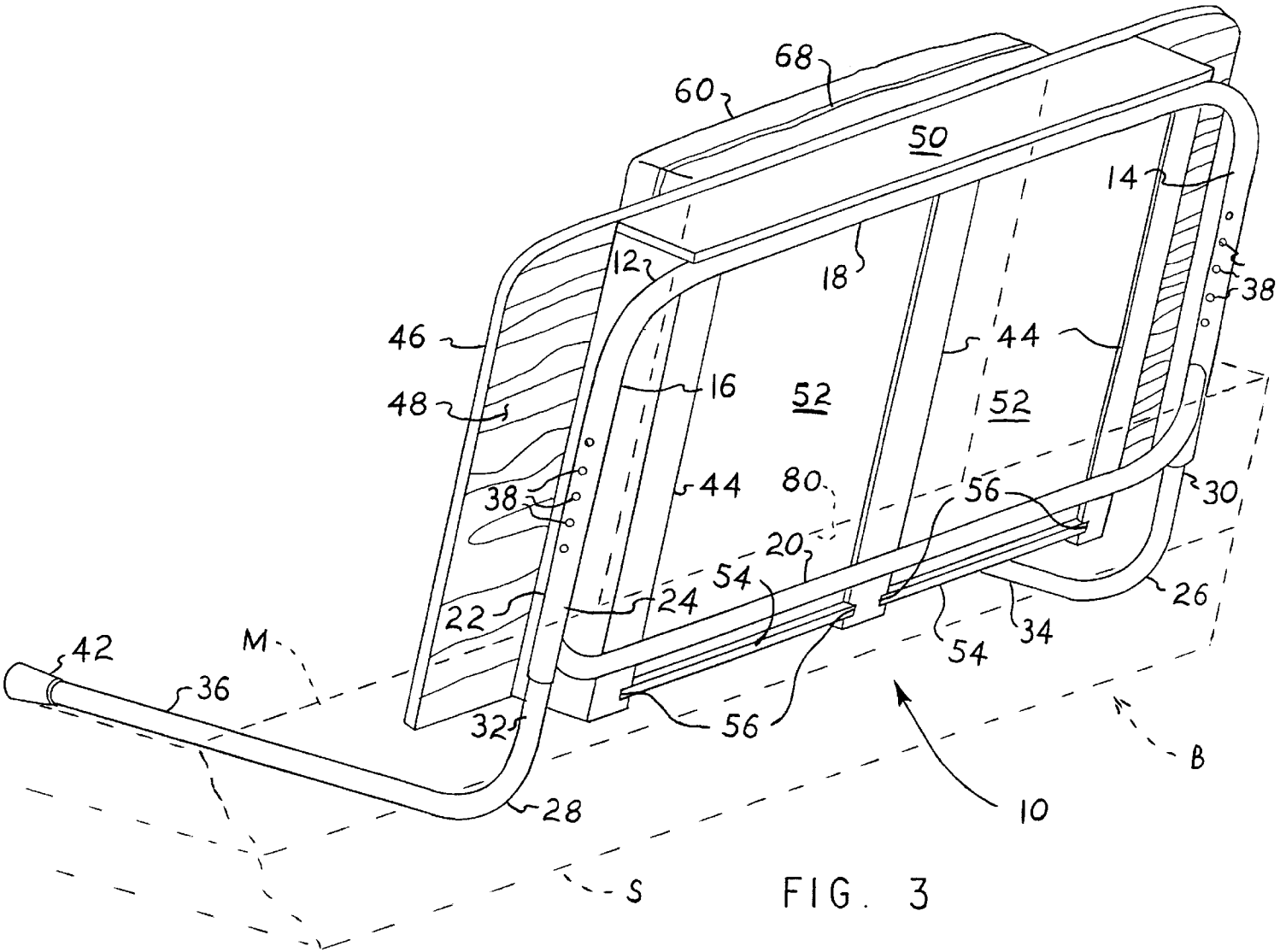
FIG. 3 is a perspective view showing the installation of the present back support to a bed, and various details of the device.

FIG. 3 illustrates the present back support 10 as it would be secured between the mattress M and box spring S or other underlying structure of the bed, as shown generally in FIGS. 1 and 2. The back support 10 is constructed on a rigid frame 12 formed of steel tubing or other suitable material. The frame 12 is generally rectangular in shape with rounded corners, and includes first and opposite second ends, respectively 14 and 16, and a top and opposite bottom member, respectively 18 and 20. The frame 12 has one side 22 which faces the bed B when the back support 10 is removably installed to the bed B, and an opposite side 24 which faces away from the bed B when the device has been installed.

Each end 14 and 16 has a leg, respectively 26 and 28, extending downwardly therefrom. The first and second legs 26 and 28 each include upper portions, respectively 30 and 32, which telescope within their respective ends 14 and 16 of the frame 12 for adjusting the height of the frame 12 relative to the thickness of the mattress M of the bed B. Each of the legs 26 and 28 also includes a lower portion, respectively 34 and 36, which forms an angle of substantially ninety degrees to the upper portion 30 and 32 of their respective legs 26 and 28. Thus, when the two lower portions 34 and 36 of the legs 26 and 28 are generally horizontal, the upper portions 30 and 32 are generally vertical, thus holding the frame 12 in a generally vertical plane for supporting the remainder of the structure of the present back support 10.

The upper portions 30 and 32 of the two legs 26 and 28 telescope within the respective first and second ends 14 and 16 of the frame 12, as noted further above. A series of adjustment holes or passages 38 are provided in each frame end member 14 and 16, with a single conventional spring loaded pin (not shown) being provided through the upper portions 30 and 32 of the two legs 26 and 28. The spring loaded pins are urged outwardly, and selectively engage each of the holes or passages 38 as the upper portions 30 and 32 of the legs 26 and 28 are telescoped into and out of their respective frame ends 14 and 16. The user may push the ends of the pins into their receptacles in the upper portions 30 and 32 of the legs 26 and 28 to disengage them from any of the holes 38 for leg height adjustment, as desired.

The cylindrical shape of the tubular frame components 14 through 20 and corresponding legs 26 and 28, also allow the upper portions 30 and 32 of the two legs 26 and 28 to pivot concentrically within their respective frame ends 14 and 16. This allows the lower portions 34 and 36 of the two legs 26 and 28 to be pivoted or swung inwardly, for folding them to lie in the same plane as the frame 12 for compact storage, as shown in broken lines in the perspective view of FIG. 6. Carrying handles 40 may be provided, for a person to carry the folded back support 10 conveniently using only one hand. A spring wire hook or latch 41 may be secured to one of the legs, e.g., the leg 36, and may be removably secured about the opposite leg 34 when the two legs 34 and 36 are folded to hold them together as shown in FIG. 6.

Figure 4:
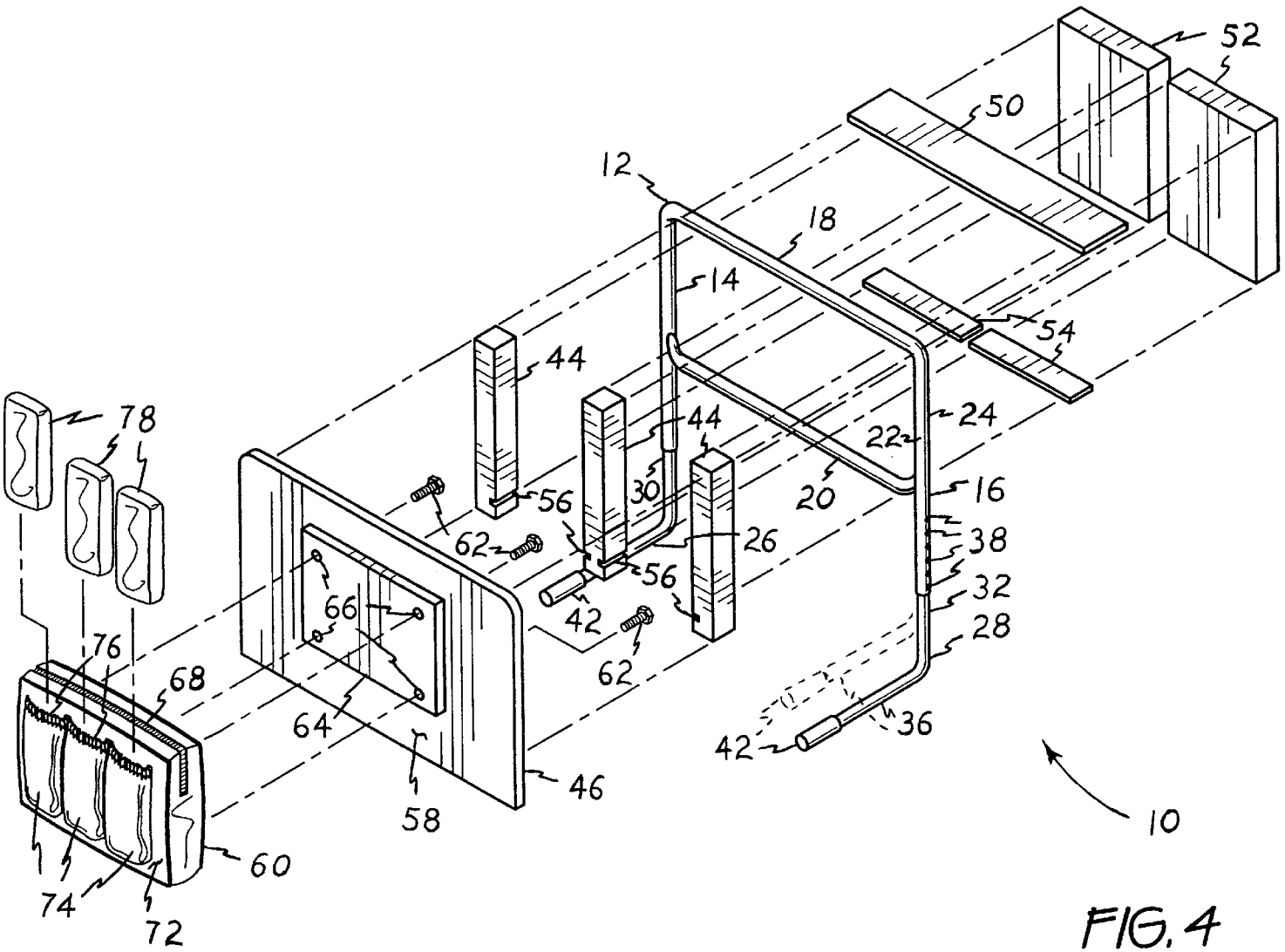
FIG. 4 is an exploded perspective view of the present back support, showing further details.
Figure 5:
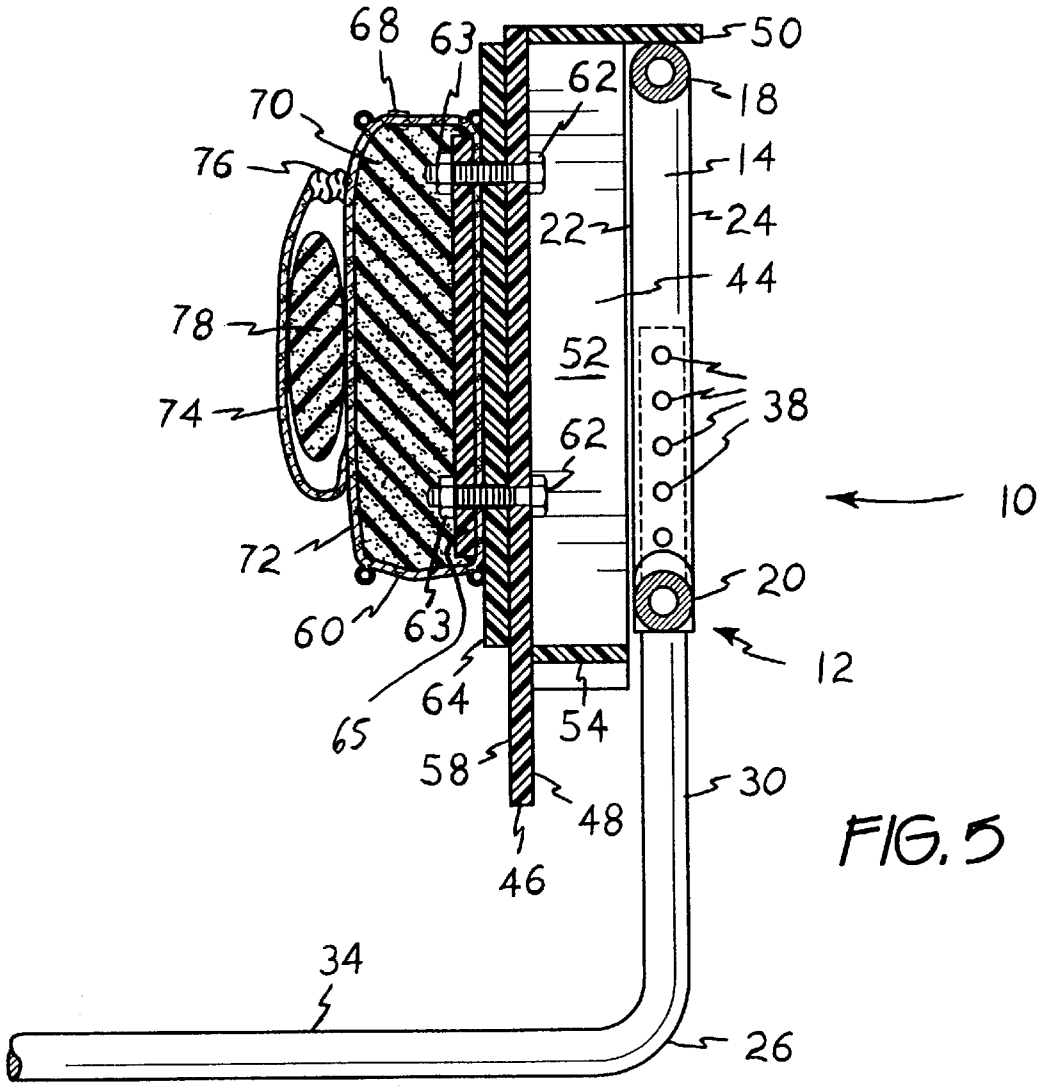
FIG. 5 is an elevation view in section of the present back support, showing further structural details thereof.
Figure 6:
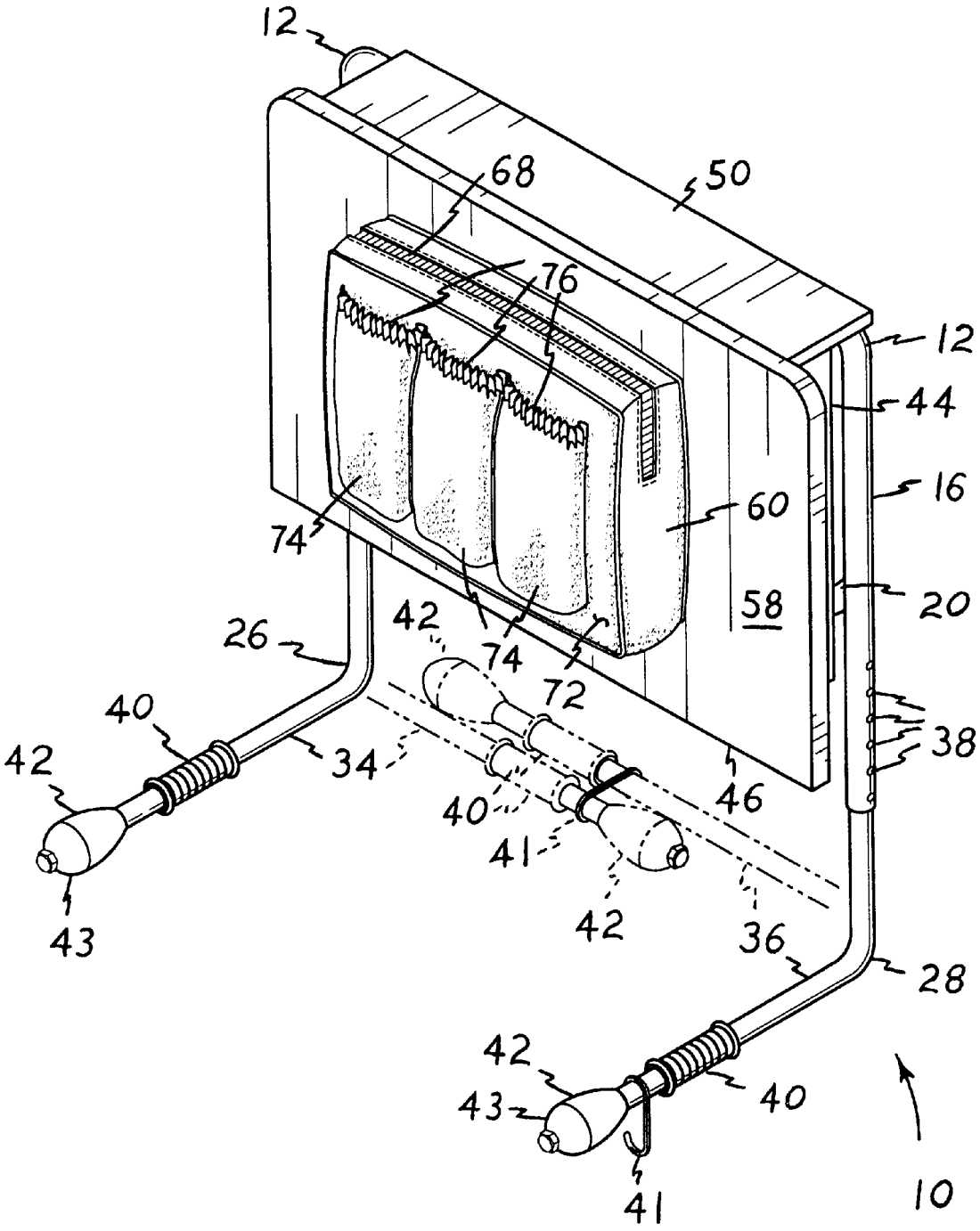
FIG. 6 is a perspective view of the back support, showing the folding of the legs for carriage and storage.

When the two lower leg portions 34 and 36 are pivotally extended to the positions shown in solid lines in FIG. 6, and also in FIGS. 3 through 5, they may be removably inserted between the mattress M of a bed B and the underlying structure, e.g., box spring S, etc., as shown in FIG. 3 of the drawings. As box spring S and mattress M are conventionally generally horizontally disposed, it will be seen that the ninety degree bends of the two legs 26 and 28 thus position the frame 12 substantially vertically to the side of the bed B., as shown in FIGS. 1 and 2 of the drawings. The leg heights may be adjusted by means of the multiple adjustment passages 38, discussed further above, in order to adjust for the thickness of the mattress M as desired. Protective tips 42 and securing bolts may be provided on the ends of legs 26 and 28. The protective tips 42 may be made from rubber and capped by a dome shaped plastic cap 43, the bolts being inserted through the cap 43 and protective tip 42 to engage a threaded bolt hole in a dowel of other support (not shown) disposed in the legs 26 and 28. The dome shaped plastic cap 43 provides easier insertion of the legs 26 and 28 between a mattress and a box spring.

The bed facing side 22 of the frame 12 includes a plurality of vertical supports 44 (at least two positioned toward opposite ends 14 and 16 of the frame 12, and preferably three) extending across the upper and lower frame members 18 and 20, and generally parallel to the two end members 14 and 16 of the frame 12. A rigid panel 46 formed of plastic or other suitable material extends across the supports 44 to provide a continuous, unbroken surface or wall, sandwiching the supports 44 between the frame attachment side 48 of the panel 46, and the bed facing side 22 of the frame 12. A top member 50 extends across the supports 44 and from the upper edge of the panel 46 across the upper member 18 of the frame 12.

The supports 44, panel 46, and top member 50 define at least one volume (preferably two), into which storage compartments 52 may be installed, for storing various articles such as liniment, heat and cold packs, etc., as desired. The compartments 52 are open on the bottom, and closed by slidably removable closures 54 engaging cooperating slots 56 in the lower ends of the supports 44. This works well, as access may be gained from above when the back support 10 is inverted for storage, and the relatively narrow thickness of the storage compartments 52 allows objects to be dropped therein when the back support 10 is inverted, or dropped therefrom when it is upright. When access is desired to one of the compartments 52, the corresponding closure 54 is removed by sliding it from the mating slots 56 of the corresponding supports 44 on opposite sides of the compartment 52. The compartment 52 is closed by replacing the closure 54 in the slots 56 of the supports 44.

The bed facing side 58 of the panel 46, i.e., the side opposite the frame attachment side 48, provides for the removable attachment of a cushion or pad 60 thereto. A reinforcement panel 64 is permanently secured to the main panel 46, with a rigid attachment panel 65 (shown in the elevation view in section of FIG. 5) installed within the cushion 60. A series of holes or fastener passages 66 are provided through the primary panel 46, the reinforcement panel 64, and the cushion attachment panel 65 and back panel of the cushion 60. A like number of plastic bolts 62 are inserted through the holes or passages 66 and engage a like number of plastic nuts 63 which are installed within the cushion 60. Thus, the cushion 60 is removably secured to the main panel 46 by the cushion attachment panel 65 clamping the back surface of the cushion 60 between the panel 65 and reinforcement panel 64 by means of the bolts 62 and mating nuts 63. This permits removal of the cushion 60 for cleaning or other maintenance.

The cushion 60 includes a zipper 68 along one edge (e.g., the top edge) thereof, for removal or insertion of padding 70 (FIG. 5) or the like therein. The zipper 68 also provides access to the interior of the cushion 60, for placement of the attachment panel 65 therein and access to the nuts 63 when installing and removing the cushion 60 to and from the panel 46. The padding material 70 may be removed for cleaning, or additional padding may be inserted therein for greater resilience, greater thickness, etc. as desired, or conversely padding may be removed as desired.

The cushion 60 includes a bed facing side or surface 72 having one or more (preferably a plurality of) flexible, resilient pocket(s) 74 secured thereto. The pockets 74 include an elastic opening 76 along the upper edge thereof, for the removable insertion of various conventional therapeutic devices 78 (e.g., hot and cold packs, etc.) therein. The pockets 74 need only be opened by elastically stretching their openings 76, and inserting therein or removing therefrom any therapeutic devices 78 desired. An absorbent material (foam, cloth, etc.) may be provided within the pouches if desired to absorb condensation from cold packs.

In summary, the back support 10 provides a much needed means of bracing the back or other body portion of a reclining person, from the bedside to which the support 10 is temporarily installed. The support 10 is easily installed by extending the two lower leg portions 34 and 36 so they are substantially normal to the plane of frame 12 and other components secured thereto. The two legs 34 and 36 are then placed between mattress M and any underlying structure (e.g., box spring S) of a bed B, as shown generally in FIG. 3.

The proper height of the cushion or pad 60 is easily adjusted by telescoping the upper portions 30 and 32 of the first and second legs 26 and 28 inwardly or outwardly (i.e., upwardly or downwardly) as desired within their respective upper leg sections comprising the frame ends 14 and 16, and selectively locking them in place by means of the adjustment holes or passages 38 in each upper leg section and the conventional spring biased pins noted further above in each inner telescoping section 30 and 32.

The relative height of the cushion or pad 60 is preferably positioned so the lower edge 80 of the cushion 60 just contacts and rests upon the upper edge of the mattress M, as shown in FIG. 3 of the drawings. This "adjustment point," defined by the line where the lower edge 80 of the cushion 60 contacts the upper edge of the mattress M, assures that a continuously padded surface comprising the mattress M and cushion 60 is provided so the user of the present back support 10 will not contact any hard or unpadded surface with any portion of his or her body while resting upon the mattress M and using the device 10, as shown in FIGS. 1 and 2.

Access to articles stored within the storage compartments 52 is provided before or after installation on the bed, by opening one of the storage compartment closures 54 to gain access to the contents therein, such as liniment, heat or cold packs, etc. The pockets 74 provide a means of holding the desired therapeutic devices in place as desired while the present back support 10 is in place on the bed. The rigid panel 46 to which the cushion 60 is secured, provides a firm and supporting surface, with the cushion 60 providing a compliant material for comfort.

When use of the present support is no longer needed, any accessories used therewith (therapeutic packs, etc.) may be stored within one or more of the storage compartments 52 provided with the device. The two lower leg portions 34 and 36 of the legs 26 and 28 may be withdrawn from their anchored positions between the mattress and underlying bed structure, and pivotally folded to lie essentially coplanar with the remainder of the frame 12 structure.

Figure 7:
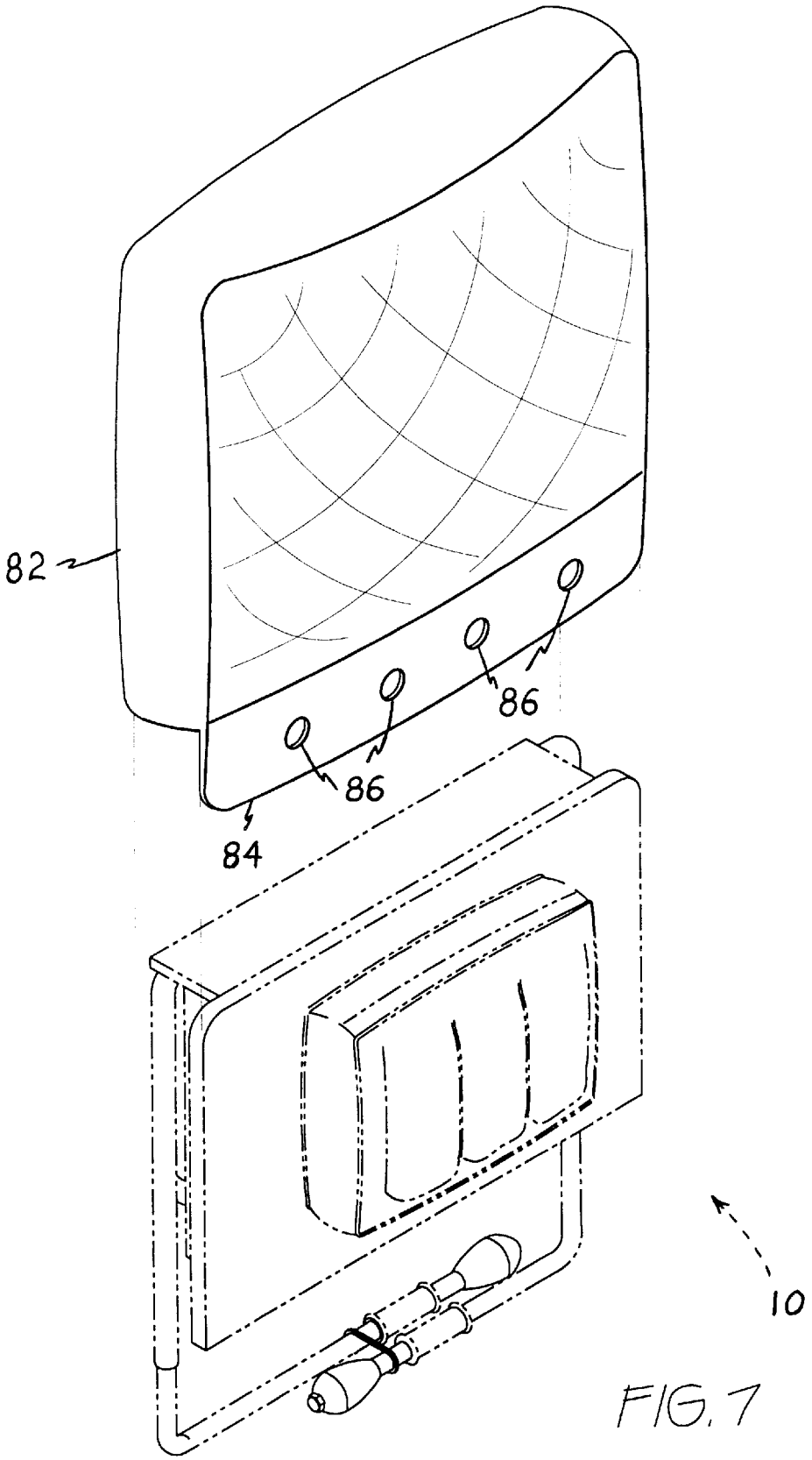
FIG. 7 is a perspective view of a cover provided for storing and protecting the present back support.

The handle 40 may then be secured about the adjacent lower leg portions for convenient carriage of the device. The present support 10 takes up little room in such a folded configuration, thus making it easily storable in a convenient location for easy access when needed. A padded cover 82 (shown in FIG. 7) may be provided for placement of the device therein, to provide an attractive appearance for the present invention when not in use. The cover 82 includes a lower edge 84 having a series of snap fasteners 86 or other suitable closure means, providing for closure of the cover 82 over the structure of the back support 10. The cover 82 may also be retained over the device when it is in use, to provide additional padding if so desired. The various panels, supports, top member, and storage compartment closures of the present back support may be formed of durable and light weight materials, such as plastic, with the present back support proving to be a most useful accessory for those who occasionally suffer from back strain or other minor but painful orthopedic problems.

It is to be understood that the present invention is not limited to the sole embodiment described above, but encompasses any and all embodiments within the scope of the following claims.

I claim:

1. A back support for removable installation to a bed, with the bed having at least a mattress and an underlying structure, said back support comprising:

a rigid frame formed of cylindrical tubular material and having a first and an opposite second end, a top and an opposite bottom member, and a bed facing side and an opposite side;

a first leg formed of cylindrical tubular material and an opposite second leg formed of cylindrical tubular material respectively depending from said first and said second end of said frame, for removably inserting between the mattress and underlying structure of the bed, wherein each said leg is concentrically and pivotally secured respectively within said first and said second end of said frame, for pivoting each said leg coplanar with said frame for storage;

each said leg having a bend of substantially ninety degrees therein, for positioning said frame generally vertically with said bed facing side of said frame facing the bed when each said leg is extended horizontally between the mattress and underlying structure of the bed;

a continuous, unbroken rigid panel secured to said bed facing side of said frame and extending completely thereover; and said panel including a bed facing side and an opposite frame attachment side, with cushioning means disposed upon said bed facing side.

2. The back support of claim 1 wherein said cushioning means is removably secured to said bed facing side of said panel.

3. The back support of claim 2, wherein said cushioning means includes a bed facing side and at least one therapeutic article containment pocket is secured across said bed facing side of said cushioning means.

4. The back support of claim 1, wherein each said leg is telescopingly adjustable respectively within said first end and said second end of said frame, for adjusting the height of said frame relative to the mattress of the bed.

5. The back support of claim 1, including a carrying handle disposed about each said leg, each said carrying handle positioned adjacently to one another when each said leg is folded coplanar with said frame and latching means extending from one said leg, for selectively securing about the other said leg for holding each said leg together and coplanar with said frame.

6. The back support of claim 1, including article storage means disposed upon said frame attachment side of said panel, said article storage means includes a plurality of spaced apart supports secured to said frame attachment side of said panel, with an article storage compartment secured between each of said supports.

7. The back support of claim 6, wherein each said article storage compartment has an open bottom, and a closure panel is slidingly disposed across each said open bottom of each said article storage compartment for selective access thereto.

8. The back support of claim 1, including article storage means, and at least said panel and said article storage means are formed of plastic material.

9. A back support for removable installation to a bed, with the bed having at least a mattress and an underlying structure, said back support comprising:

a rigid frame having a first and an opposite second end, a top and an opposite bottom member, and a bed facing side and an opposite side;

a first and an opposite second leg respectively depending from said first and said second end of said frame, for removably inserting between the mattress and underlying structure of the bed, each said leg having a bend of substantially ninety degrees therein, for positioning said frame generally vertically with said bed facing side of said frame facing the bed when each said leg is extended horizontally between the mattress and underlying structure of the bed;

a continuous, unbroken rigid panel secured to said bed facing side of said frame and extending completely thereover, said panel including a bed facing side and an opposite frame attachment side, with cushioning means disposed upon said bed facing side; and article storage means disposed upon said frame attachment side of said panel, said article storage means includes a plurality of spaced apart supports secured to said frame attachment side of said panel, with an article storage compartment secured between each of said supports, each said article storage compartment has an open bottom, and a closure panel is slidingly disposed across each said open bottom of each said article storage compartment for selective access thereto.

10. A back support for removable installation to a bed, with the bed having at least a mattress and an underlying structure, said back support comprising:

a rigid frame having a first and an opposite second end, a top and an opposite bottom member, and a bed facing side and an opposite side;

a first and an opposite second leg respectively depending from said first and said second end of said frame, for removably inserting between the mattress and underlying structure of the bed;

each said leg having a bend of substantially ninety degrees therein, for positioning said frame generally vertically with said bed facing side of said frame facing the bed when each said leg is extended horizontally between the mattress and underlying structure of the bed;

a plurality of evenly spaced, generally vertically disposed supports secured to said bed facing side of said frame;

a continuous, unbroken rigid panel secured across said plurality of supports opposite said frame, and extending completely over said supports;

a top member extending across said supports, said frame, and said panel; and at least one article storage compartment disposed between each of said supports, said panel, and said top member, each said article storage compartment has an open bottom, a closure panel is slidingly disposed across each said open bottom of each said article storage compartment for selective access thereto.

11. The back support of claim 10, wherein said panel includes a bed facing side and including a cushion removably secured to said bed facing side of said panel.

12. The back support of claim 11, wherein said cushion includes a bed facing side and at least one therapeutic article containment pocket is secured across said bed facing side of said cushion.

13. The back support of claim 10, wherein said frame, said first leg, and said second leg are formed of cylindrical tubular material.

14. The back support of claim 13, wherein each said leg is telescopingly adjustable respectively within said first end and said second end of said frame, for adjusting the height of said frame relative to the mattress of the bed.

15. The back support of claim 13, wherein each said leg is concentrically and pivotally secured respectively within said first and said second end of said frame, for pivoting each said leg coplanar with said frame for storage.

16. The back support of claim 15, including:

a carrying handle disposed about each said leg, each said carrying handle positioned adjacently to one another when each said leg is folded coplanar with said frame; and latching means extending from one said leg, for selectively securing about the other said leg for holding each said leg together and coplanar with said frame.

17. The back support of claim 10, wherein at least said panel, said supports, said top member, and said article storage compartment are formed of plastic material.

18. The back support of claim 10, including cover means.

* * * * *